US010206503B2

(12) United States Patent
Stuffel et al.

(10) Patent No.: US 10,206,503 B2
(45) Date of Patent: Feb. 19, 2019

(54) DEVICE AND METHOD FOR FIXING A PUSH ELEMENT

(71) Applicant: PAUL HETTICH GMBH & CO. KG, Kirchlengern (DE)

(72) Inventors: Andreas Stuffel, Bueckeburg (DE); Juergen Weidlich, Roedinghausen (DE); Marvin Buhmeier, Petershagen (DE); Helmut Meyer, Bueckeburg (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 0 days.

(21) Appl. No.: 15/569,158

(22) PCT Filed: May 3, 2016

(86) PCT No.: PCT/EP2016/059886

§ 371 (c)(1),
(2) Date: Oct. 25, 2017

(87) PCT Pub. No.: WO2016/177729

PCT Pub. Date: Nov. 10, 2016

(65) Prior Publication Data

US 2018/0153304 A1 Jun. 7, 2018

(30) Foreign Application Priority Data

May 4, 2015 (DE) ..... 10 2015 106 855

(51) Int. Cl.
*A47B 88/00* (2017.01)
*A47B 88/427* (2017.01)
*A47B 88/407* (2017.01)

(52) U.S. Cl.
CPC ..... *A47B 88/427* (2017.01); *A47B 88/407* (2017.01); *A47B 2088/4272* (2017.01);
(Continued)

(58) Field of Classification Search
CPC ..... A47B 88/427; A47B 88/403; A47B 96/06; A47B 88/407; A47B 88/40; A47B 88/423
(Continued)

(56) References Cited

U.S. PATENT DOCUMENTS 5,588,729 A * 12/1996 Berger ..... A47B 88/427 312/330.1
5,737,820 A 4/1998 Ferrari et al.
(Continued)

FOREIGN PATENT DOCUMENTS

AT 506879 * 12/2009
AT 508 544 A4 2/2011
(Continued)

OTHER PUBLICATIONS

International Search Report of PCT/EP2016/059888, dated Jul. 26, 2016.
(Continued)

*Primary Examiner* — Janet M Wilkens
(74) *Attorney, Agent, or Firm* — Collard & Roe, P.C.

(57) ABSTRACT

A device for fixing a push element, in particular a drawer box to a rail of a pull-out guide, the device comprising a clamping mechanism with a receptacle, into which a web-shaped holding part can be inserted, wherein a self-locking clamping element is provided at the receptacle, by means of which the holding part is secured in a clamping manner against being pulled out. As a result, a particularly stable fixation of the drawer box to a pull-out guide can be achieved.

19 Claims, 6 Drawing Sheets

(52) U.S. Cl.
CPC ..... *A47B 2088/4274* (2017.01); *A47B 2088/4276* (2017.01); *A47B 2088/4278* (2017.01); *A47B 2210/0056* (2013.01)

(58) Field of Classification Search
USPC ..... 312/334.7, 223.1, 334.4, 334.5, 348.1, 312/348.2, 334.6, 333; 384/22
See application file for complete search history.

(56) References Cited

U.S. PATENT DOCUMENTS

| | | | | |
|---|---|---|---|---|
| 6,913,334 | B2 | 7/2005 | Weichelt | |
| 8,056,994 | B2 * | 11/2011 | Chen | A47B 88/427 312/334.14 |
| 8,424,984 | B2 | 4/2013 | Ritter | |
| 8,727,460 | B2 | 5/2014 | Grabher | |
| 8,764,136 | B2 * | 7/2014 | Grabherr | A47B 88/427 312/334.27 |
| 8,854,769 | B1 * | 10/2014 | Liang | A47B 88/427 360/125.51 |
| 9,066,587 | B1 * | 6/2015 | Liang | A47B 88/0422 |
| 9,259,087 | B1 * | 2/2016 | Hsiao | A47B 88/0055 |
| 9,808,083 | B2 * | 11/2017 | Lucas | A47B 88/427 |
| 9,986,829 | B2 * | 6/2018 | McGregor | A47B 88/427 |
| 2003/0234603 | A1 * | 12/2003 | Salice | A47B 88/407 312/334.5 |
| 2004/0095047 | A1 * | 5/2004 | Salice | A47B 88/427 312/332.1 |
| 2004/0227440 | A1 * | 11/2004 | Booker | F16F 9/0218 312/334.1 |
| 2008/0218045 | A1 * | 9/2008 | Moser | A47B 88/427 312/333 |
| 2013/0113356 | A1 * | 5/2013 | Salice | A47B 88/0422 312/334.44 |
| 2013/0257244 | A1 * | 10/2013 | Salice | A47B 88/0418 312/319.1 |
| 2014/0015390 | A1 * | 1/2014 | Grabherr | A47B 88/04 312/334.4 |
| 2014/0175965 | A1 * | 6/2014 | Salice | A47B 88/04 312/334.1 |
| 2014/0210330 | A1 * | 7/2014 | Amann | A47B 88/0422 312/334.1 |
| 2014/0314347 | A1 | 10/2014 | Huang | |
| 2015/0147008 | A1 * | 5/2015 | McGregor | A47B 88/0422 384/22 |
| 2016/0025124 | A1 * | 1/2016 | Roedder | F16B 12/04 403/14 |
| 2016/0128476 | A1 * | 5/2016 | Ng | A47B 88/16 312/333 |
| 2017/0105525 | A1 | 4/2017 | Klaus | |
| 2017/0347794 | A1 * | 12/2017 | McGregor | A47B 88/49 |
| 2018/0140095 | A1 * | 5/2018 | Stuffel | A47B 88/427 |
| 2018/0146782 | A1 * | 5/2018 | Boekhoff | A47B 88/427 |
| 2018/0146783 | A1 * | 5/2018 | Stuffel | A47B 88/427 |

FOREIGN PATENT DOCUMENTS

| | | | |
|---|---|---|---|
| AT | 510714 | * | 6/2012 |
| AT | 512748 | * | 10/2013 |
| AT | 518136 | * | 7/2017 |
| DE | 4301327 | * | 8/1993 |
| DE | 696 14 443 | T2 | 5/2002 |
| DE | 20 2004 001 791 | U1 | 5/2004 |
| DE | 20 2009 017 319 | U1 | 5/2011 |
| DE | 202009013706 | * | 5/2011 |
| DE | 20 2010 007 765 | U1 | 11/2011 |
| DE | 202011004588 | * | 7/2012 |
| DE | 10 2011 000 724 | A1 | 8/2012 |
| DE | 10 2013 104 829 | A1 | 11/2014 |
| DE | 10 2013 104 830 | A1 | 11/2014 |
| DE | 102013104829 | * | 11/2014 |
| DE | 21 2013 000 112 | U1 | 12/2014 |
| DE | 10 2014 104 136 | A1 | 10/2015 |
| EP | 606564 | * | 7/1994 |
| EP | 695523 | * | 2/1996 |
| EP | 1 285 604 | B1 | 10/2005 |
| JP | 2004160224 | * | 6/2004 |
| WO | 2007118632 | * | 10/2007 |
| WO | 2009/149479 | A1 | 12/2009 |
| WO | 2010040273 | * | 4/2010 |
| WO | 2010129303 | * | 11/2010 |
| WO | 2011094776 | * | 8/2011 |
| WO | 2012092634 | * | 7/2012 |
| WO | 2014065523 | * | 5/2014 |
| WO | 2014/180899 | A1 | 11/2014 |
| WO | 2015/120493 | A1 | 8/2015 |

OTHER PUBLICATIONS

German Search Report in DE 10 2015 106 856.7 dated Mar. 8, 2016 with English translation of relevant parts.
International Search Report of PCT/EP2016/059887, dated Jul. 26, 2016.
German Search Report in DE 10 2015 106 873.7 dated Mar. 9, 2016 with English translation of relevant parts.
International Search Report in PCT/EP2016/059886, dated Jul. 26, 2016.
German Search Report in DE 10 2015 106 855.9 dated Mar. 8, 2016 with English translation of relevant parts.
International Search Report in PCT/EP2016/059890, dated Jul. 26, 2016.
German Search Report in DE 10 2015 106 852.4 dated Feb. 26, 2016 with English translation of relevant parts.
International Search Report in PCT/EP2016/059885, dated Jul. 26, 2016.
German Search Report in DE 10 2015 106 854.0 dated Feb. 29, 2016 with English translation of relevant parts.

* cited by examiner

DEVICE AND METHOD FOR FIXING A PUSH ELEMENT

CROSS REFERENCE TO RELATED APPLICATIONS

This application is the National Stage of PCT/EP2016/059886 filed on May 3, 2016, which claims priority under 35 U.S.C. § 119 of German Application No. 10 2015 106 855.9 filed on May 4, 2015, the disclosures of which are incorporated by reference. The international application under PCT article 21(2) was not published in English.

BACKGROUND OF THE INVENTION

The present invention relates to a device for fixing a push element, in particular a drawer, to a rail of a pull-out guide, said device comprising a clamping mechanism with a receptacle into which a web-shaped holding part can be inserted, wherein a self-locking clamping lever is provided on the receptacle, by means of which the holding part is secured in a clamping manner against being pulled out, and a method for fixing a push element.

EP 1 285 604 discloses a device for fixing a drawer to a rail of a pull-out guide, in which a base part which can be fastened to the drawer and a latching element which can be fixed to the pull-out guide are provided. In order to compensate for the distance between the guide rails of the pull-out guides, the latching element can be displaced within specific tolerances relative to the base part. The holding forces are limited by the design of the latching element and the base part as a plastic part, especially in the case of heavy drawers which extend in the pull-out direction up to the maximum pull-out position. In addition, it is desirable to position the drawer as precisely as possible within the furniture body in order to obtain an attractive joint pattern.

WO 2009/149479 discloses a device for releasably coupling a drawer with a pull-out guide, in which a holding part and a counter-holding part are connected to one another via a resilient material piece. This leads to a reduction of the positional accuracy in the longitudinal direction. In the lateral direction, the drawer is fixed to the rail by means of a latching device. In the case of the standard stop tests for drawers, in which the drawers are pulled out with load, however, comparatively low holding forces of such a latching connection are obtained.

SUMMARY OF THE INVENTION

It is therefore the object of the present invention to provide a device and a method for fixing a push element in which high holding forces can be provided.

This object is achieved by a device and a method according to the invention as described below.

The device according to the invention for fixing a push element comprises a clamping mechanism with a receptacle into which a web-shaped holding part can be inserted, wherein a self-locking clamping lever is provided on the receptacle by means of which the holding part is secured in a frictionally engaged manner against pulling out. As a result, a particularly stable securing of the push element can take place by means of the self-locking clamping lever, in particular also with regard to stop tests, in which the drawer is moved into the maximum opening position in the loaded state. The self-locking clamping element of the clamping mechanism ensures that the holding part is held in such a way that it cannot be pulled out further from the receptacle in the opening direction. However, insertion of the holding part into the receptacle of the clamping mechanism is comparatively simple since only small frictional forces have to be overcome so that assembly can be designed in a simple manner. In addition, a force-locked connection of the clamping lever can be used to effect a stepless fixing of the holding part, which allows particularly precise positioning of the push element in the opening direction.

A frictionally engaged or force-locked connection according to the invention differs from a form-fitting connection in that the holding forces are provided by frictional forces and not by form-fitting abutment elements, such as teeth or stops. In this way, a stepless adjustment of the holding part can be obtained in the case of a force-locked fixing of the holding part, which is independent of stop elements.

For the force-locked connection, the web-shaped holding part can have a substantially planar surface, which in certain areas is in contact with a contact surface on the clamping lever. The holding part can be strip-shaped, angled, U-shaped, produced as a hollow profile or with other geometries, in particular made of metal, wherein a section of a profile can be used for the frictionally engaged connection. The holding part can also be formed by a section of the pull-out guide profile.

Preferably, the clamping element is formed as a clamping lever and is rotatably mounted about a pivot. In this case, the clamping lever can be pretensioned into a locked position, in particular via one or more springs or via an energy storage device. It is also possible that the clamping element comprises at least one clamping lever which is movable by bending. Other clamping elements such as wedges or clamping elements on curve guides can also be used.

According to a preferred embodiment of the invention, means for unlocking the clamping element are provided, by means of which the force-locked connection of the clamping element can be released from the holding part. A linearly movable slide can be provided for unlocking the clamping element. Alternatively, a pivotable lever can be used in order to move the clamping element to an unlocking position.

Preferably, the clamping element rests on the holding part via a linear contact surface, which extends parallel to the pivot of the clamping element. The contact surface can be edge-shaped, rounded or designed with a different contact surface to provide high clamping forces. In this clamping system, the high clamping forces are generated by a multiplication of forces by the lever effect.

The holding part can be secured in a stepless manner to the clamping mechanism, so that the drawer is mounted on the pull-out guide during assembly and is pushed in slightly, and as soon as the holding part is fixed to the clamping mechanism, the fitter is given the certainty that the drawer is unable to slip inadvertently when it is pulled out of the pull-out guide in the opening direction. Rather, the clamping mechanism is activated as soon as the holding part is guided past the clamping element in the receptacle. Subsequent further insertion of the drawer for stepless adjustment is thus easily possible.

For a particularly stable fastening of the drawer, the holding part and the contact surface of the clamping element resting on the holding part can be made of metal, for example of a steel sheet. In contrast to metal, plastic flows, so that only small forces can be absorbed via the clamping mechanism, wherein the use of plastic materials, in particular reinforced plastics, is certainly possible.

Preferably, the pivot of the clamping lever is arranged in the insertion direction in front of a contact surface of the clamping lever on the holding part. As a result, self-locking is effected, wherein, in the mounted position, an angle between the contact surface of the clamping element with respect to the pivot can be arranged at an angle to the longitudinal direction of the holding part between 55° and 89°, in particular 70° to 85°. Due to the angular position of the clamping element or clamping lever, the freewheeling direction and the locking direction are defined in the clamping system. When the holding part is loaded in the locking direction, a self-reinforcing effect occurs, so that the clamping force also increases with rising loading of the holding part in the locking direction.

For easy assembly, the receptacle may be formed on a fastening part on which the clamping lever is rotatably mounted. Then the clamping lever can be pre-mounted with the receptacle as a unit on the rail or the drawer. Preferably, the fastening part is displaceably mounted on or in a housing. As a result, the fastening part can be moved relative to the housing via means for lateral adjustment, so that an exact alignment of the drawer is also possible in the horizontal direction perpendicular to the movement direction of the pull-out guide. A height adjustment and/or a depth adjustment can also be provided.

BRIEF DESCRIPTION OF THE DRAWINGS

The invention will be explained in closer detail below with reference to two exemplary embodiments with reference to the attached drawings, wherein.

DETAILED DESCRIPTION OF THE INVENTION

Figure 1:
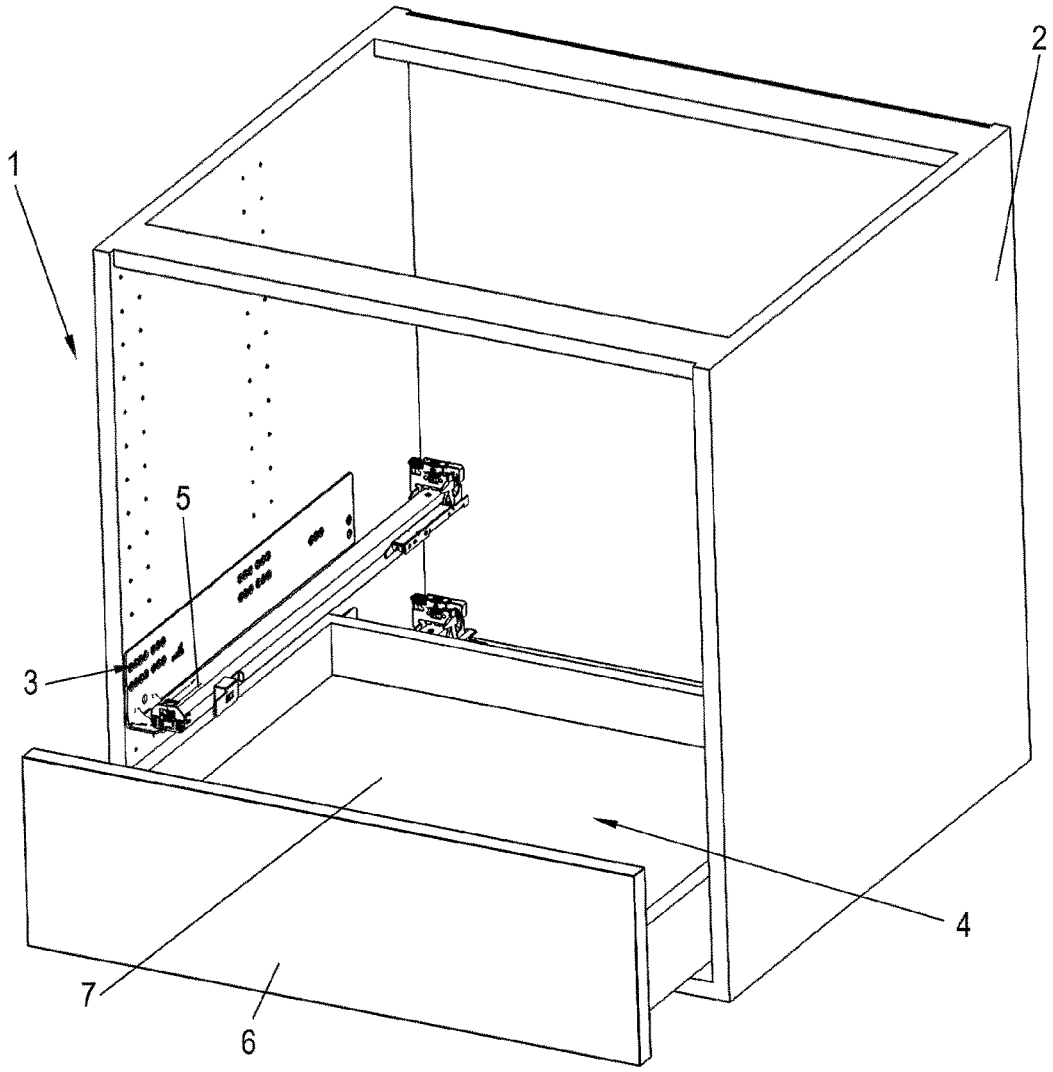
FIG. 1 shows a perspective view of a piece of furniture with a drawer.

A piece of furniture 1 comprises a furniture body 2, on the side walls of which one or more pull-out guides 3 are fixed, which have at least one movable rail 5. A drawer 4 is held displaceably on two such rails 5, wherein a device 10 is provided on each rail 5 for fixing the drawer 4 to the rail 5, as can be seen from the bottom view of FIG. 2. On a bottom 7 of the drawer 4, a first device 10 and a second device 10 are provided for fixing the drawer to a respective rail 5. Each device 10 comprises a housing 15, which is fixed to a front panel 6 and/or to the bottom 7 of the drawer 4. At least one of the devices 10 can comprise a lateral, height or depth adjustment in order to position the front panel 6 in the horizontal direction perpendicularly to the pull-out direction.

Figure 2:
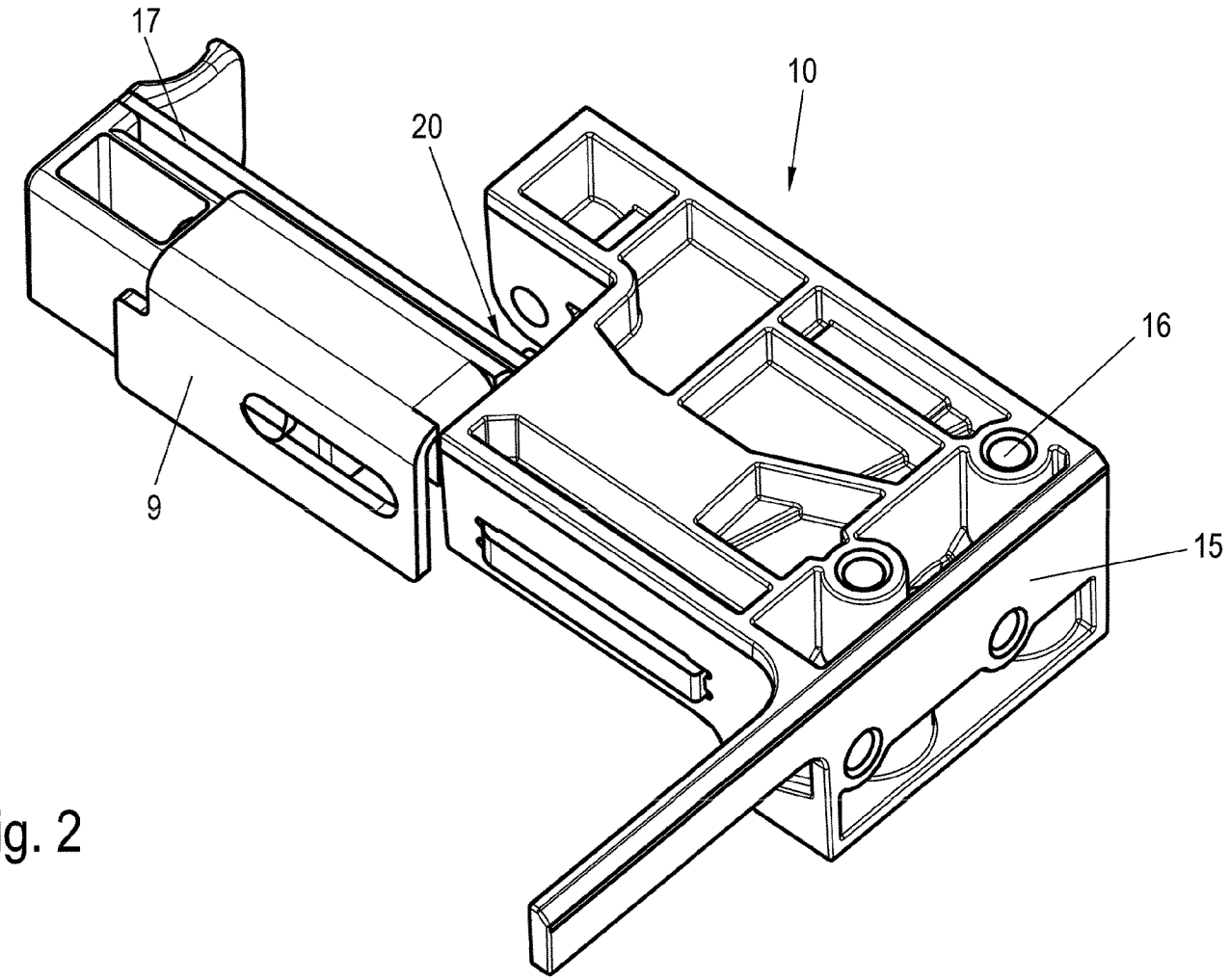
FIG. 2 shows a perspective view of a device for fixing a push element without a drawer.
Figure 3:
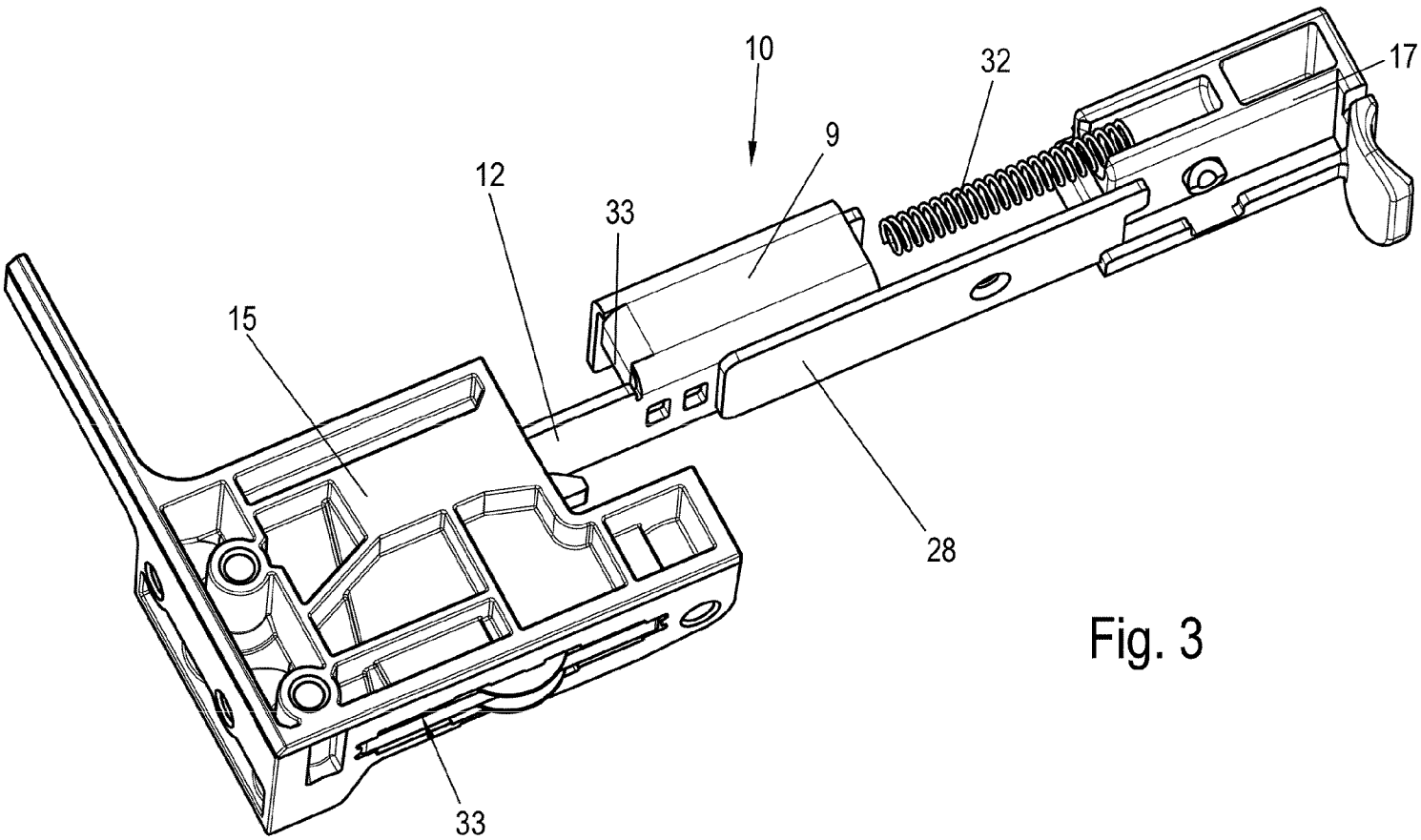
FIG. 3 shows a perspective exploded view of the device of FIG. 2.
Figure 4:
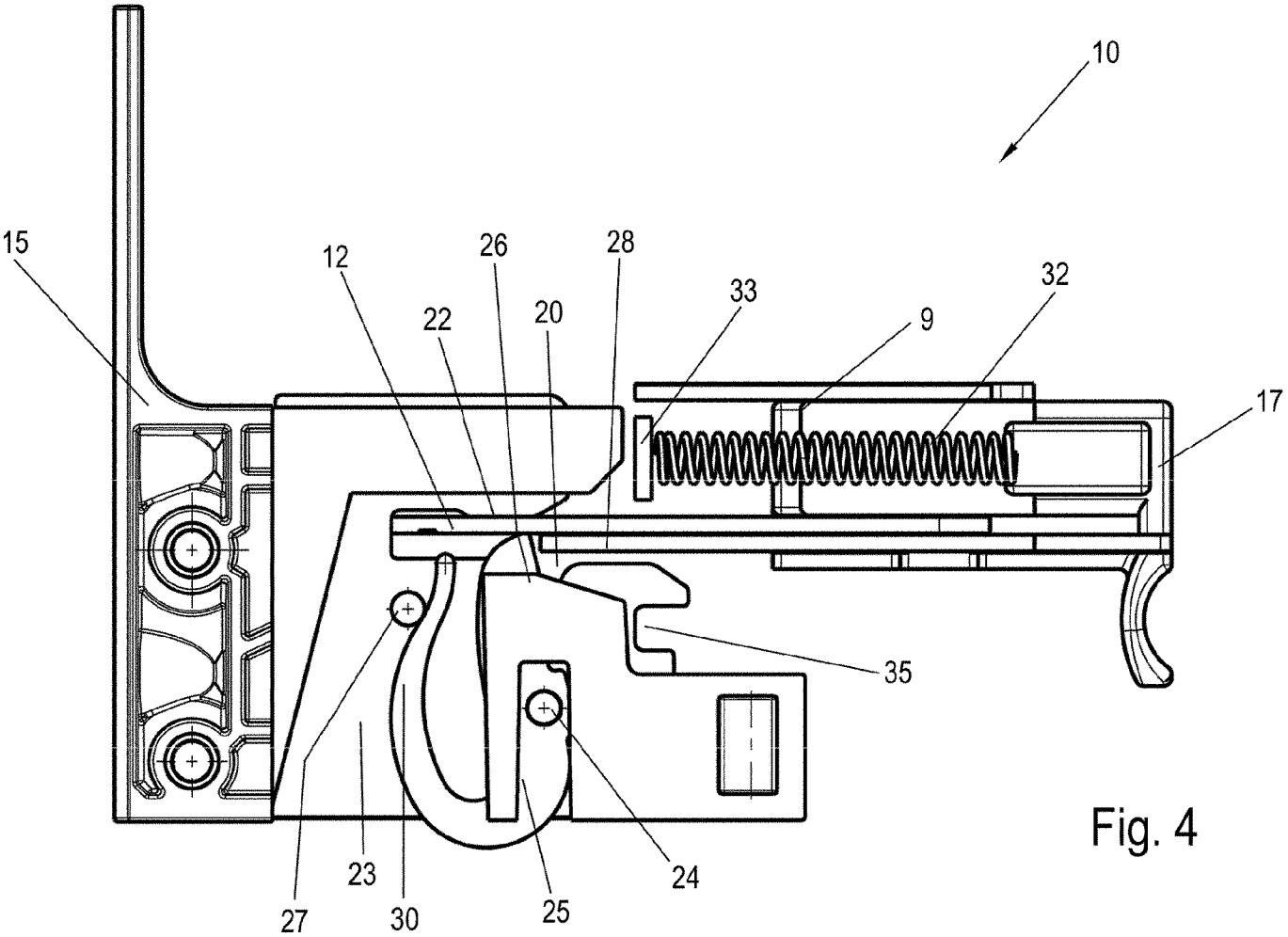
FIG. 4 shows a top view of the device of FIG. 2 as a horizontal section.

In the detailed view of FIGS. 2, 3 and 4, the device 10 is shown with the housing 15. The housing 15 is fixed via fastening means on openings 16 to the underside of the drawer 4, wherein a receptacle 20 is provided for inserting a holding part 12. The holding part 12 is attached to the rail 5 of the pull-out guide 3. In this case, the web-shaped holding part 12 can optionally be an integrally formed tab 9 fixed to the rail 5, or can be fixed to the rail 5 as at least one further component, or the holding part 12 is a part of the rail profile of the rail 5. A device for depth adjustment can be provided on the web-shaped holding part 12 in order to adjust the insertion depth of the holding part 12 into the receptacle 20. Optionally, such a device for depth adjustment can also be dispensed with.

For assembly, the drawer 4 is placed on the two rails 5 of the two pull-out guides 3 and pushed into the closed position. In this case, a respective web-shaped holding part 12 is inserted at opposite sides into the receptacle 20 of the device 10 and fixed via a clamping mechanism that secures the holding part 12 by clamping and frictional engagement against pulling out.

FIG. 4 shows the device 10 during assembly of the holding parts 12, which is inserted into the receptacle on the housing 15. A linearly movable web 28 is provided adjacent to the holding part 12, which web is connected to a slide 17 which is pretensioned to an initial position via a spring 32. The spring 32 is supported on the one hand on the slide 17 and on the other hand on a stop 33 on the tab 9.

As is shown in FIG. 4, the web-shaped holding part 12 is pushed for assembly into the receptacle 20 and secured there against pulling out. For this purpose, a clamping mechanism is provided on the receptacle 20 which comprises a clamping lever 25 which is rotatably mounted about an axis 24. The clamping lever 25 comprises a contact surface 26 which can be placed in a force-locked manner against a lateral surface of the holding part 12. On the opposite side, the holding part 12 is supported by a side wall 22 which is formed on a plate-shaped fastening part 23, on which the clamping lever 25 is also rotatably mounted. The clamping lever 25 comprises an integrally formed spring 30 which rests on a stop 27 in order to pretension the clamping lever 25 into the locked position. When the holding part 12 is inserted, the lever 25 is pivoted against the force of the spring 30.

The clamping lever 25 is made from a bent sheet metal, which engages in a U-shaped manner around a section of the plate-shaped fastening part 23. The contact surface is formed on the bottom of the U, which rests as a linear contact surface 26 on the holding part 12.

For the purpose of releasing the clamping effect, the holding web 28 can be pushed by the slide 17 against the force of the spring 32 into the receptacle 20, by means of which the clamping lever 25 is pressed in a counterclockwise manner in FIG. 4 and thus lifts off the holding part 12. In this position, the holding part 12 can be pulled out of the receptacle 20 in a destruction-free manner.

Figure 5:
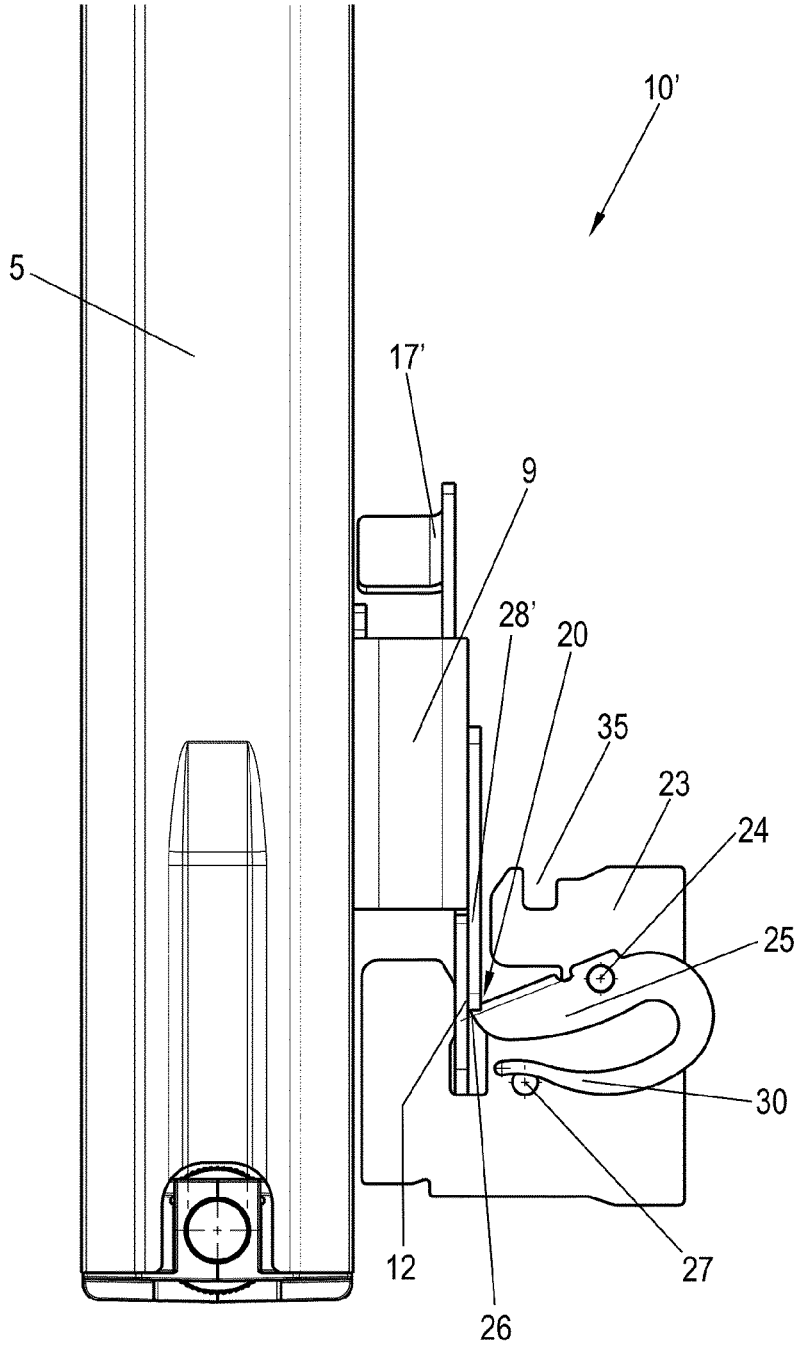
FIG. 5 shows a view of a modified device for fixing a push element without housing.
Figure 6:
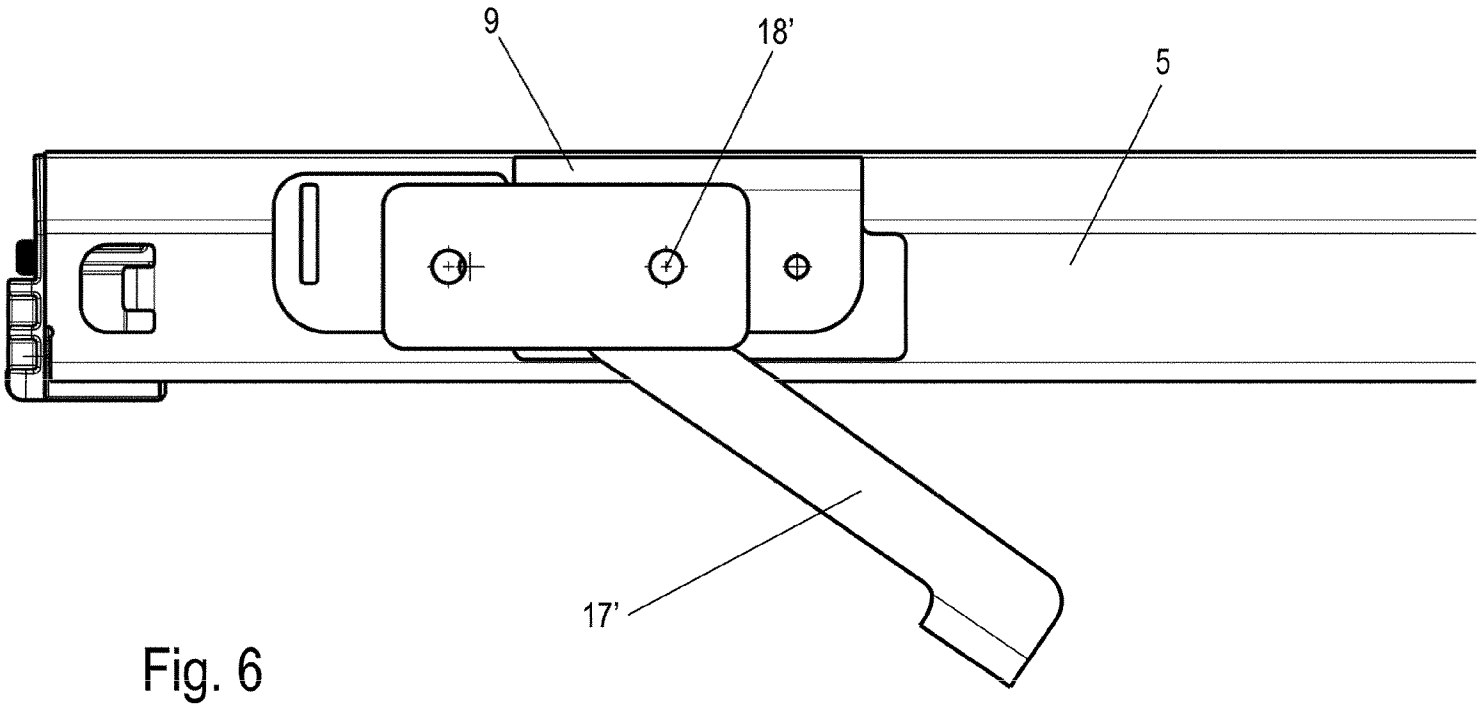
FIG. 6 shows a view of the device of FIG. 5 during unlocking.

FIG. 5 shows a modified device 10' for fixing a drawer to a rail 5 of a pull-out guide, in which the housing 15 was masked out. A web-shaped holding part 12 is inserted into the receptacle 20 as in the preceding embodiment, and is fixed there via the clamping lever 25 in a force-locked manner, wherein the means for unlocking are not formed by a linearly displaceable slide 17 but by a pivotable lever 17'. As is illustrated by the view of FIG. 6, the lever 17' can be pivoted and thus move the clamping lever 25 to an unlocking position. As a result, the holding part 12 can be moved out of the receptacle 20 and the drawer can be released from the pull-out guide 5. The lever 17' is in connection with an unlocking element 28' which respectively moves the clamping lever 25.

Apart from that, this exemplary embodiment is formed like the first exemplary embodiment.

Optionally, a device 18 for lateral, height, and depth adjustment can be provided in the devices 10 in order to adjust the joint pattern. The device for lateral adjustment can comprise a knurled nut for example which engages in a receptacle 35 and ensures by rotation that the housing 15 is laterally moved in the horizontal direction relative to the receptacle 20.

In the exemplary embodiment shown, both the clamping lever 25 and the fastening part 23 consist of metal, in particular of a steel sheet. As a result, particularly high holding forces can be applied to the likewise metallic holding part 12.

LIST OF REFERENCE NUMERALS

1 A piece of furniture
2 Furniture body
3 Pull-out guide
4 Drawer
5 Rail
6 Front panel
7 Bottom
8 Tab
10 Device
12 Holding part
15 Housing
16 Openings
17 Slide
17' Lever
20 Receptacle
22 Side wall
23 Fastening part
24 Pivot
25 Clamping lever
26 Contact surface
27 Stop
28 Holding web
28' Unlocking element
30 Spring
32 Spring
33 Stop
35 Receptacle

What is claimed is:

1. A device for fixing a push element in the form of a drawer (4) to a rail (5) of a pull-out guide (3), comprising a clamping mechanism with a receptacle (20), into which a web-shaped holding part (12) can be inserted, wherein a self-locking clamping element (25) is provided on the receptacle (20), by means of which the holding part (12) is secured in a force-locked manner against pulling out, and further comprising a device for unlocking the clamping element by which the force-locked connection of the clamping element can be released from the holding part (12), wherein the device for unlocking the clamping element is configured to be inserted into the receptacle (20) in order to pivot the clamping element (25).

2. The device according to claim 1, wherein the clamping element (25) is formed as a clamping lever (25) and is rotatably mounted about a pivot (24).

3. The device according to claim 2, wherein the clamping element (25) rests via a linear contact surface (26) against the holding part (12), which extends parallel to the pivot (24) of the clamping element (25).

4. The device according to claim 2, wherein the pivot (24) of the clamping element (25) is arranged in the insertion direction in front of a linear contact region (26) of the clamping element (25) on the holding part (12).

5. The device according to claim 1, wherein the clamping element (25) is pretensioned into the locked position.

6. The device according to claim 5, wherein the clamping element (25) is pretensioned into the locked position by an integrally formed spring (30).

7. The device according to claim 1, wherein the device (28, 28') for unlocking can be moved by a linearly guided slide (17) or a pivotable lever (17').

8. The device according to claim 1, wherein the holding part (12) can be secured in a stepless manner on the clamping mechanism.

9. The device according to claim 1, wherein the surface of the clamping element (25) resting against the holding part (12) and the holding part (12) are made of metal.

10. The device according to claim 1, wherein at least one adjusting device is provided, which is configured to move the drawer (4) relative to the pull-out guide (3) in at least one spatial direction.

11. The device according to claim 1, wherein the receptacle (20) is formed on a fastening part (23) on which the clamping element (25) is rotatably mounted.

12. The device according to claim 11, wherein the fastening part (23) is displaceably mounted on or in a housing (15).

13. The device according to claim 12, wherein the fastening part (23) is movable relative to the housing (15) via a device for lateral adjustment.

14. The device according to claim 1, wherein a device for depth adjustment can be provided on the holding part (12) in order to adjust the insertion depth of the holding part (12) into the receptacle (20).

15. The device according to claim 1, wherein the clamping element (25) comprises at least one clamping lever which can be moved by bending.

16. The device according to claim 1, wherein a fastening part (23) is provided on which the clamping element (25) is arranged indirectly or directly, or the clamping element (25) is formed integrally with the fastening part (23).

17. The device according to claim 1, wherein the holding part (12) or the clamping mechanism is configured to be arranged on a front region of the drawer (4).

18. A piece of furniture (1) having a furniture body (2) and at least one drawer (4) which is movably held on the furniture body (2) via two pull-out guides (3), and at least one pull-out guide (3) is connected to the drawer (4) via the device according to claim 1.

19. A method for fixing a push element in the form of a drawer (4) to a rail (5) of a pull-out guide (3), comprising a clamping mechanism with a receptacle (20), into which a web-shaped holding part (12) can be inserted, wherein a self-locking clamping element (25) is provided on the receptacle (20), by which the holding part (12) is secured in a force-locked manner against pulling out, wherein the frictionally engaged connection is terminated by inserting an element into the receptacle between the holding part (12) and the clamping element (25), and the holding part (12) can be separated from the clamping mechanism by pivoting the clamping element (25).

* * * * *